US009273462B2

(12) United States Patent
Black et al.

(10) Patent No.: US 9,273,462 B2
(45) Date of Patent: Mar. 1, 2016

(54) SYSTEM AND METHOD OF MANUFACTURE FOR BUILDING PANELS

(71) Applicant: IFRAME BUILDING SOLUTIONS, LLC, Scottsdale, AZ (US)

(72) Inventors: Jeffrey Black, Scottsdale, AZ (US); Gregory Mater, Glendale, AZ (US); Jessica Garcia, Phoenix, AZ (US)

(73) Assignee: IFRAME BUILDING SOLUTIONS, LLC, Scottsdale, AZ (US)

( * ) Notice: Subject to any disclaimer, the term of this patent is extended or adjusted under 35 U.S.C. 154(b) by 368 days.

(21) Appl. No.: 13/622,970

(22) Filed: Sep. 19, 2012

(65) Prior Publication Data

US 2013/0067838 A1 Mar. 21, 2013

Related U.S. Application Data

(60) Provisional application No. 61/536,892, filed on Sep. 20, 2011, provisional application No. 61/585,998, filed on Jan. 12, 2012.

(51) Int. Cl.

| | |
|---|---|
| ***E04C 2/34*** | (2006.01) |
| ***E04B 2/90*** | (2006.01) |
| ***E04C 2/22*** | (2006.01) |
| ***E04C 2/38*** | (2006.01) |
| ***E04B 1/14*** | (2006.01) |
| ***E04B 1/80*** | (2006.01) |

(52) U.S. Cl.

CPC ... *E04B 2/90* (2013.01); *E04B 1/14* (2013.01); *E04B 1/80* (2013.01); *E04C 2/22* (2013.01); *E04C 2/384* (2013.01)

(58) Field of Classification Search

CPC .... E04B 2002/7488; E04B 1/14; E04C 2/521
USPC ..... 52/220.2, 220.3, 220.7, 309.7, 309.16, 52/592.1
See application file for complete search history.

(56) References Cited

U.S. PATENT DOCUMENTS

| | | | | |
|---|---|---|---|---|
| 2,371,921 | A * | 3/1945 | Tucker | 52/667 |
| 4,850,169 | A * | 7/1989 | Burkstrand et al. | 52/241 |
| 4,951,436 | A * | 8/1990 | Burkstrand et al. | 52/241 |
| 5,822,940 | A * | 10/1998 | Carlin et al. | 52/479 |
| 5,842,276 | A * | 12/1998 | Asher et al. | 29/897.32 |

(Continued)

FOREIGN PATENT DOCUMENTS

| | | |
|---|---|---|
| JP | 07259217 | 10/1995 |
| JP | 2004084221 | 3/2004 |

(Continued)

OTHER PUBLICATIONS

International Search Report and the Written Opinion of the International Searching Authority, or the Declaration dated Feb. 27, 2013 in Application No. PCT/US2012/056132.

*Primary Examiner* — Charles A Fox
*Assistant Examiner* — James Buckle, Jr.
(74) *Attorney, Agent, or Firm* — Snell & Wilmer L.L.P.

(57) ABSTRACT

The present disclosure relates to prefabricated building panels for use in structures, and walls external to structures, such as outdoor privacy walls and the like. More particularly, the present disclosure relates to a method and system for providing building panels that provide improved structural integrity, distribute loads, thermal performance, among other attributes using conventional framing members fit into precision cut grooves.

19 Claims, 14 Drawing Sheets

(56) References Cited

U.S. PATENT DOCUMENTS

| | | | | |
|---|---|---|---|---|
| 5,943,775 | A * | 8/1999 | Lanahan et al. | 29/897.32 |
| 6,085,485 | A * | 7/2000 | Murdock | 52/783.19 |
| 6,167,624 | B1 * | 1/2001 | Lanahan et al. | 29/897.32 |
| 7,543,419 | B2 * | 6/2009 | Rue | 52/630 |
| 7,963,080 | B1 * | 6/2011 | Bowman | 52/414 |
| 7,964,272 | B2 * | 6/2011 | Guevara et al. | 428/312.4 |
| 2005/0204697 | A1 * | 9/2005 | Rue | 52/782.1 |
| 2010/0269442 | A1 | 10/2010 | Black | |
| 2013/0133277 | A1 * | 5/2013 | Lewis | 52/220.1 |

FOREIGN PATENT DOCUMENTS

| | | |
|---|---|---|
| KR | 100675225 | 1/2007 |
| KR | 100828432 | 5/2008 |

* cited by examiner

SYSTEM AND METHOD OF MANUFACTURE FOR BUILDING PANELS

CROSS REFERENCE TO RELATED APPLICATIONS

The present application claims priority to U.S. Provisional Application Ser. No. 61/536,892 entitled "SYSTEM AND METHOD OF MANUFACTURE FOR BUILDING PANELS" filed Sep. 20, 2011. The present application also claims priority to U.S. Provisional Ser. No. 61/585,998 entitled "SYSTEM AND METHOD OF MANUFACTURE FOR BUILDING PANELS" filed on Jan. 12, 2012. The disclosures of each are incorporated herein by reference in their entirety for any purpose.

FIELD

The present disclosure relates to prefabricated building panels for use in structures, and walls external to structures, such as outdoor privacy walls and the like. More particularly, the present disclosure relates to a method and system for providing building panels that provide improved structural integrity, distributed loads, and thermal performance among other attributes.

BACKGROUND

Recent changes in the construction industry have led to an increased use by builders of prefabricated building components manufactured offsite. Despite its many benefits, however, builders have not fully embraced prefabricated building components using alternatives to conventional wood framing. For example, even though steel framing has many advantages over conventional wood framing, there has been reluctance in residential construction, and some types of commercial construction, to use components made from steel, rather than wood, due in part to the belief that steel is more costly. Dimensioned lumber prices, however, are highly volatile. An insulated steel frame panel system that is cost competitive to conventional wood framing, incorporates recognized and readily available components, and that is easily and quickly assembled and installed, has many advantages over conventional wood framing and would be embraced by the building industry and building owners.

A number of panels have been designed that incorporate foam insulation for improved thermal performance. These panels, however, often incorporate nonstandard light gage steel framing members (e.g., U.S. application Ser. No. 11/825,562 to Miller, U.S. application Ser. No. 11/282,351 to Onken et al., U.S. patent application Ser. No. 11/068,608, to Rue, U.S. Patent Application Publication No. 2011/0047912 to Armijo, U.S. application Ser. No. 11/361,189 to Bowman) and often require the manufacture of the panel within a mold, (e.g., Rue and U.S. Pat. No. 5,399,462, to McKinney). Others envision the insertion of framing members in larger channels or voids in the foam or that require an adhesive to lubricate the stud insertion and/or to adhere the stud in the foam (e.g., Miller).

New building codes recognize the importance of eliminating thermal bridging. Newer codes require a layer of continuous insulation unless a wall assembly can demonstrate an acceptable level of thermal performance without it. The layer of continuous insulation creates new building challenges, among which are fastening and exterior finish details, moisture control, and the ratio of rigid continuous insulation to batt or loose fill insulation in the wall cavity.

Since a structural panel by nature generally requires support on both the exterior and interior of the panel, some panelized systems use nonstandard steel framing members in order to create sufficient strength in the steel member to avoid multiple connecting bridges through the panel. For example, the nonstandard framing member in Miller has additional bends in the steel framing member to provide additional strength. While such efforts can help avoid thermal bridging, the use of a nonstandard framing member generally requires extensive and expensive testing to demonstrate compliance with building codes, including structural analyses and fire testing under superimposed loads if the foam is intended to serve any structural support purpose. A panelized system that minimizes thermal bridging but which emphasizes the use of conventional steel framing members will be more economical to manufacture and will ensure more rapid acceptance by the building industry.

Other building panel systems that incorporate nonstandard light gage steel members and foam insulation have addressed thermal bridging in various ways, but generally are designed in ways that will also require substantial structural (and other) testing to gain acceptance by the building industry and building code officials. Also, they generally require a manufacturing process that is complex and not economical. These factors have generally limited the commercial practicability of these approaches.

Fireblocking is used to prevent the free passage of flame to other areas of the building through concealed spaces. To meet fire/building code specifications and improve fire safety, a panelized system that is used in balloon framing or as a curtain wall in certain other multistory construction will require fireblocking as part of the wall assembly to meet flammability requirements, as well as lateral and vertical flame spread in some building applications.

In traditional construction, cable/utility runs in walls are not well integrated with the framing. Groupings of tubing (such as PEX plumbing), electrical, data, voice, and audio wiring are often commingled or loose in a common area within a cable/utility run wall cavity. These cables, wires and tubing are generally secured in wood framing using secondary means (such as staples, nails, clips, and tacks), which may puncture the cables, wires and/or tubing upon coupling to the wall. In steel framing, similar attachment means are used such as tie wire, clips, hangars, and mechanical fasteners, each of which may also puncture or abrade the cables, wires, and/or tubing. Moreover, the channel/utility run often results in an opening for thermal, sound, and vibration inefficiencies. In a solid panel system, planning for the placement of cable and utility run is an important feature.

Conventional steel framing members in EPS panels may have a top track and a bottom track. The bottom track may be attachable to a floor, and the top track may be attachable to a ceiling. However, these tracks may present an opportunity for sound and/or vibration to travel from one side of the wall to the other, as well as create a thermal bridge from one side of the panel to the other. Mechanical air handling equipment and elevators in buildings cause harmonic vibrations. These vibrations can cause mechanical connections to loosen, structural and nonstructural welds to weaken, and nuisance noise production through the structure.

SUMMARY

These above disclosed needs are successfully met via the disclosed system and method. In accordance with various aspects, a method and system for providing panels with improved thermal, acoustic, and vibration characteristics is disclosed. In accordance with various embodiments of the present disclosure a method and system for providing precision cuts to tight tolerances to allow insertion of conventional framing members in exoskeletal panels of variable design length, width, and thickness, in a desired axis (such as the X, Y or Z axis in a Cartesian coordinate system) without use of a lubricant or securing adhesive is disclosed, and without the use of cumbersome and limiting EPS panel molding processes. In this way, conventional materials may be used in a non-standard application. Thus, stringent building codes based on conventional shaped and formed materials, such as C shaped studs, may be fashioned into a panel using precision cut grooves.

In accordance with various embodiments of the present disclosure, to distribute loads across the exoskeleton, a lateral transfer plate and/or stud tie track is disclosed for use in these exoskeletal panels integrated with a foam core, permitting the framing to be staggered and providing the same or different stud spacing on each side of the panel. Further, a method and system for the lateral transfer plate to be used as integrated fireblocking in such panels is disclosed.

In accordance with various embodiments of the present disclosure a slip transfer plate may be placed at the top of an infill wall panel to improve the structural integrity of the exoskeleton. For instance, studs in the exoskeleton may be fastened to the slip transfer plate through slotted flanges in the plate, which allow for vertical movement of the floorplate above the panel.

Conventional systems may introduce voids, leaks and/or thermal bridging that may compromise the thermal envelope. In accordance with various embodiments of the present disclosure a method and a system for interlocking corners is provided. For instance, the interlocking corner is configured to eliminate the thermal bridging associated with conventional construction. Additionally, the presently described corner system allows for the continuity of horizontal utility chases. Moreover, this corner system also creates a uni-directional shear connection not created in conventional corner construction methods. A need also exists for an integral corner system in a prefabricated panel system. In accordance with various embodiments of the present disclosure a method and a system with studs oriented in both the X axis orientation and Y axis orientation according to an exemplary embodiment fit into precision cut, highly tolerance grooves is depicted. In various embodiments, these grooves are cut to mirror the shape and exterior surface of the studs to result in a fit with as little gap between the stud and polymeric insulated core as possible.

In accordance with various embodiments of the present disclosure, a method and a system with a split steel track with integral gasket is disclosed. This gasket, such as a foam gasket, may be configured to create integral sound, vibration, and thermal break at the track. This track may be attachable to a ceiling or a floor.

In accordance with various embodiments of the present disclosure, an exemplary system and panel is configured to provide a utility run (chase/channel) with precision cut grooves for retaining cables, wires and tubing. In accordance with an exemplary embodiment, an exemplary panel comprises a multi-purpose EPS chase with interlocking EPS plug configured to provide compression channels in the panel. The channels are suitably sized to hold low voltage electrical wires, PEX plumbing, and the like.

Further, in accordance with additional embodiments of the present disclosure, an exemplary system and panel for improved coupling of building panels to other panels (such as in taller walls and at a corner), and to floors and ceilings is disclosed.

In accordance with various embodiments of the present disclosure a panel comprising a polymeric insulated core comprising a steel exoskeleton of steel studs, and a lateral transfer plate comprises an opening to receive a first stud, wherein the opening corresponds to the shape of the first stud is disclosed. This panel may comprise fireblocking elements proximate to the lateral transfer plate. This panel may include a slip transfer plate having an opening to receive the first stud, wherein the opening mirrors the shape of the stud and wherein the slip transfer plate comprises a flange having a slot to receive a fastener for coupling the first stud. The panel may include a contiguous precision cut groove cut out of the polymeric insulated core configured to receive a first steel stud, wherein the precision cut groove corresponds to the shape of the first stud. The first steel stud may be a conventionally shaped C steel stud. The panel may include at least one precision cut chase useable to receive utility runs, wherein the chase further comprises individual channels cut to friction fit at least one of a wire, cable or tube. At least a portion of each channel may correspond to the exterior dimensions of the at least one of the wire, the cable or the tube.

Further, in accordance with additional embodiments of the present disclosure, the lateral transfer plate may include a flange configured to be fastened to the first stud. The panel is constructed from parts in accordance with AISI S200 requirements. Moreover, the lateral transfer plate may be configured to be integrated into a furring wall panel in which a plurality of studs are arranged in a row. The lateral transfer plate may be configured to disperse a load in the lateral direction. This Panel may include a slip transfer plate comprising an opening to receive the first stud, wherein the opening mirrors the shape of the stud and wherein the slip transfer plate comprises a flange having a slot to receive a fastener for coupling the first stud. The panel may be part of a panel system having an interlocking outside corner steel structural element and an inside corner steel structural element.

Further, in accordance with additional embodiments of the present disclosure, a panel comprising a polymeric insulated core comprising a steel exoskeleton of steel studs and at least one precision cut chase useable to receive utility runs, wherein the chase further comprises an individual channel cut to receive, via friction fit, at least one of a wire, cable or tube is disclosed. This panel may comprise a lateral transfer plate comprising an opening to receive the first steel C shaped stud, wherein the opening mirrors the shape of the C shaped stud. This panel may include a slip transfer plate comprising an opening to receive the first stud, wherein the opening mirrors the shape of the first stud and wherein the slip transfer plate comprises a flange having a slot to receive a fastener for coupling the first stud. This panel may include a stud tie track configured to eliminate unbraced flanges. At least a portion of the each channel within the chase corresponds to the exterior dimensions of the at least one of the wire, the cable or the tube. The panel may be configured to be coupled to a second panel using a single first steel C shaped stud.

In accordance with additional embodiments of the present disclosure, a panel assembly comprising a first polymeric insulated core comprising a steel exoskeleton of steel studs, a second polymeric insulated core comprising a steel exoskeleton steel studs; and an interlocking outside corner steel structural element and an inside corner steel structural element is disclosed.

In accordance with additional embodiments of the present disclosure, a panel comprising a first polymeric insulated core and a contiguous precision cut groove cut out of the core configured to receive a first steel stud, wherein the precision cut groove corresponds to the shape of the first stud is disclosed. The first steel stud may be a conventional steel stud. The conventional steel stud may be a C shaped conventional steel stud comprising a web, a flange and a lip. The C shaped stud may be oriented in any suitable orientation; however, in an embodiment, the stud is oriented such that a long side of the C shaped stud is oriented orthogonal to the face of the panel. This C shaped stud is traditionally slid into position from the top or bottom edge of the panel.

In accordance with additional embodiments of the present disclosure, a panel assembly is disclosed comprising a first polymeric insulated core comprising a steel exoskeleton of steel studs may comprise a first panel configured to be coupled to a second panel using a single steel C shaped stud. This single stud may span at least one of: more than, less than or the span of both the first panel and the second panel.

In accordance with additional embodiments of the present disclosure, a panel assembly comprising a first polymeric insulated core comprising a steel exoskeleton of steel studs and a slip transfer plate comprising an opening to receive a first stud, wherein the opening corresponds to the shape of the stud and wherein the slip transfer plate comprises a flange having a slot to receive a fastener for coupling the first stud is disclosed.

Such systems, methods, and panels can be used for and by builders of prefabricated building components, commercial buildings, residential building, storage or containment structures, exterior sound barrier/privacy walls, mobile structures, and other types of walls and enclosures. Such systems, methods and panels can suitably distribute loads, improve thermal performance, vibration dampening, structural integrity, and provide fire-blocking capability.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION OF EXEMPLARY EMBODIMENTS

Figure 1A:
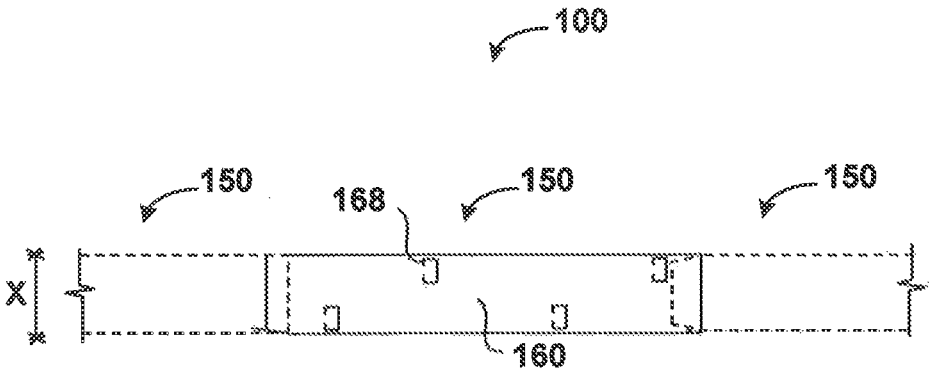
FIG. 1A is a plan view of the lateral transfer plate according to an exemplary embodiment.

The present systems, apparatus and methods are described herein in terms of various functional components and various processing steps. It should be appreciated that such functional components may be realized by any number of hardware or structural components configured to perform the specified functions. For example, the present disclosure may employ various foam core portions in varying densities or foam types, and conventional stud framing members and the like whose structure, dimension, gage, and composition may be suitably configured for various intended purposes. In addition, the present systems, apparatus and methods described herein may be practiced in any application where building panels are desired, and the examples herein are merely for exemplary purposes, as the systems, apparatus and methods described herein can be applied to any similar application.

A simple prefabricated building product that incorporates conventional light gage steel framing members in a manner that minimizes thermal bridging sufficiently to meet energy efficiency requirements without the need for a separate layer of continuous insulation provides significant advantages over prior systems. To gain acceptance, such a system should be cost competitive to manufacture and install. For example, in accordance with various embodiments, a method and system for providing building panels 150 with an improved steel exoskeleton that makes efficient use of conventional steel components while meeting load requirements is described. Such systems, methods and panels 150 can be used for and by builders of prefabricated building components, commercial buildings, residential building, storage structures, exterior sound barrier walls, mobile structures, and other types of walls and enclosures.

In various embodiments, one or more panels 150 may include a core 151 made of an insulating material, preferably, expanded polystyrene (EPS) ranging in density from about 0.75 pcf to about 3.0 pcf. Importantly, the panels 150 may include an exoskeleton of stiffeners (studs 120); each spaced, such as to national and international building code requirements at 24-inches on center (24" OC) or 16-inches on center (16" OC), to form a rigid support framework. The studs 120 may be made of galvanized steel, in various gages according to structural and building code requirements, such as AISI S200.

The result is a prefabricated panel system that incorporates conventional light gage steel framing members in an exoskeletal design that minimizes thermal bridging, but permits the manufacture of panels to a building's specifications without the requirement of a complex and limiting panel molding process. A panel system which is economical to manufacture, and meets energy efficiency requirements without a layer of continuous insulation outside the panel. A panel design that allows the insertion of conventional steel framing members within foam profiles cut to tight tolerances such that the framing member may be inserted without lubricant or adhesive, yet fits snugly within the panel after insertion and the exposed steel is flush with the surfaces of the foam in the panel is achieved. For instance, using the present system a conventional stud, which generally comprise a web, a flange and a lip, may be inserted into a precision fit in grooves. Additionally, according to various embodiments, a system and panel which distributes loads across the exoskeleton and addresses or eliminate unbraced flanges in order that the exoskeletal wall will distribute loads efficiently and meet building requirements without the use of heavier than normal steel gage members is achieved.

Historically, EPS panel makers have attempted to use non-conventional steel studs (which lack the web, a flange and a lip of a conventional steel stud) as they have encountered problems inserting these conventional steel studs into EPS cut-outs. Other makers have employed a cumbersome, inflexible, and expensive molding process.

Unlike in conventional wood or steel framing, the studs 120 do not extend from the exterior surface to the interior surface. Instead, the studs 120 forming the exoskeleton are each inserted in grooves 170 precision cut in the foam core to mirror the shape and form of the stud 120. As used herein, to mirror refers to substantially track, correspond to, complement and/or follow, such as by approximating the contours and/or exterior shape of an element. Accordingly, conduction across the studs 120 from the exterior to the interior, and vice versa, does not occur because the studs 120 do not extend through the panels 150, thereby minimizing thermal bridges through the panel 150. In an exemplary embodiment, the panels 150 may have a top track 180 and a bottom track 190, which may be attached prior to or during panel 150 installation. These tracks (180, 190) may be made from steel, such as conventional steel track. The panel bottom tracks 190 are attachable to a floor, such as a concrete floor, using suitable fasteners. The panel top tracks 180 are attachable to a ceiling using suitable fasteners. Any suitable mating or attachment method can be used to join adjacent panels 150. Accordingly, workers can build a wall, for example by connecting a series of panels 150 together, and fastening the bottom 190 and top tracks 180.

Figure 1B:
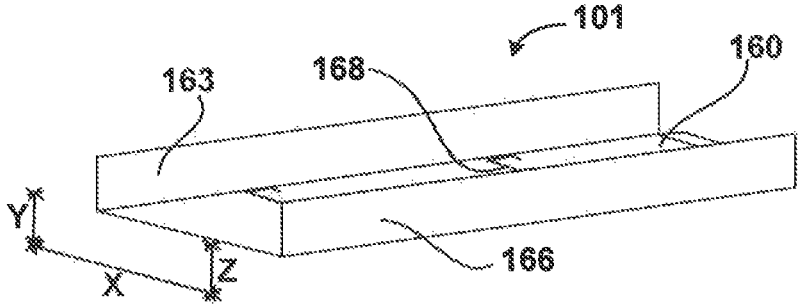
FIG. 1B depicts a side view of a "C" shaped lateral transfer plate according to an exemplary embodiment
Figure 1C:
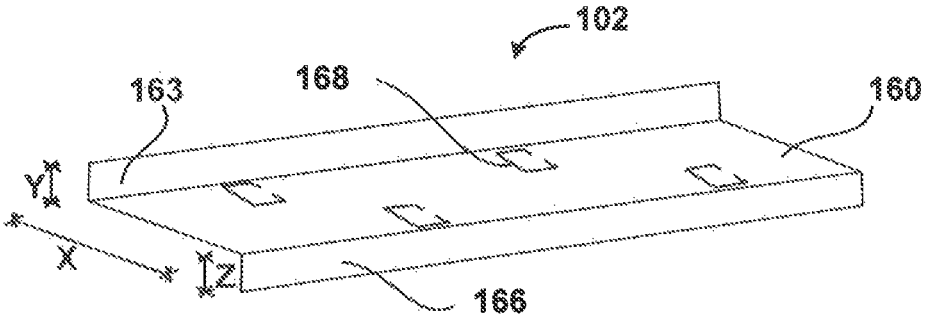
FIG. 1C depicts a side view of a "Z" shaped lateral transfer plate according to an exemplary embodiment.
Figure 1D:
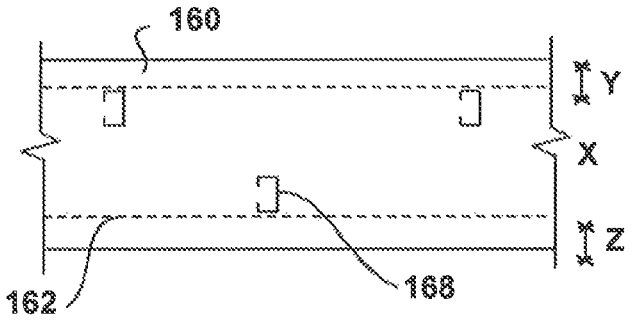
FIG. 1D is a top cut away view of a template prior to bending to firm one or more flanges into either a C shaped lateral transfer plate, a Z shaped lateral transfer plate, or an L shaped lateral transfer plate and prior to punching or cutting the penetrations for the stud profiles according to an exemplary embodiment.

In accordance with an exemplary embodiment, an exemplary system 100 and panel 150 includes an integrated lateral transfer plate 160. This integrated lateral transfer plate 160 can be made of light gage steel, such as 18 gage cold formed steel, or it can be made of other materials, such as carbon fiber that provide lower thermal conductivity combined with the material properties required to provide the desired load transfers, such as in the lateral direction and, in some applications, fire retardant properties. The stud 120 profiles 168 may be punched or cut into the plate 160 so that the steel studs 120 are inserted through the plate 160. The foam core 151 for the panel 150 may be configured with pre-cut precision grooves 170 for the studs 120 such that the foam core 151 may be integrated into the panel 150 assembly that contains the lateral transfer plate 160. In an embodiment, the lateral transfer plate 160 contains flanges of any suitable dimension. For instance, the flanges may be between about ¾" high to 6" high or greater, depending on the application ("about" in this context means plus or minus 33% of the dimensional range). The flanges may be fastened to the studs 120 on each side of the panel 150 exoskeleton with screws or may be welded in some applications, such as through contact welding. The lateral transfer plate 160 with stud 120 profile penetrations can take any suitable shape, such as a "C" shape (See FIG. 1E), much like the shape of standard light gage steel track, or it may take a "Z" shape (See FIG. 1F) or an "L" shape in certain applications. Referring to the figures, the C shaped lateral transfer plate 160 is illustrated in FIG. 1B. For instance, FIG. 1B depicts a side view of a "C" shaped lateral transfer plate with a width of "X", depending on the thickness of the wall panel, and an attachment flange 163 and 166 on opposite sides, with the length of "Y" and "Z" variable from about ¾" to 6" or more according to an exemplary embodiment, depending on the application. FIG. 1C depicts a side view of a "Z" shaped lateral transfer plate with a width of "X", depending on the thickness of the wall panel, and an attachment flange 163 and 166 on opposite sides, with the length of "Y" and "Z" variable from about ¾" to 6" or more according to an exemplary embodiment, depending on the application. FIG. 1G depicts a side view of an "L" shaped lateral transfer plate with a width of "X", depending on the thickness of the wall panel, and an attachment flange 163 and a straight attachment extension 167 on the opposite side, with the length of "Y" and "Z" variable from about ¾" to 6" or more according to an exemplary embodiment, depending on the application. In various embodiments, the lateral transfer plate 160 may be integrated into a furring wall panel in which the studs 120 are arranged in a single row. One flange of the plate 160 may be fastened to the interior of an exterior wall, such as a mass wall comprising concrete or CMU, to provide an insulated interior furring wall. A portion of the flange in such plate 160 may be cut away so that the fastening points become separate tabs and not a continuous flange.

In an exemplary embodiment, the integrated lateral transfer plate 160 may permit the gage of the steel studs 120 used in the panel's exoskeleton to be reduced from what would be requisite without the lateral transfer plate 160, but enable the panel 150 to still meet or exceed the required loads. The lateral transfer plate 160 may also allow a consistent stud 120 spacing in the panels, such as at 24" on center, for a variety of wall panel applications. The lateral transfer plate 160 may also have one or both of its flanges made longer to enable the lateral transfer plate 160 to serve as an exterior or interior ledger in some applications, such as a ledger to which an exterior deck or other exterior horizontal building component may be affixed. The lateral transfer plate 160 may be created in various shapes to match the profile of associated wall components. For example, a lateral transfer plate 160 that mirrors the shape and dimensions of an "L" or "Z" shaped corner component 200 in this panel system 100 can simplify the production and installation of the plate 160 in a wall corner by eliminating the need for two separate plates 160 and by avoiding cutting, mitering, and overlapping of two separate corner plates. In some applications, the lateral transfer plate 160 may have an extension 167 that overlaps the lateral transfer plate 160 in the adjacent wall panel 150 to give the lateral transfer plate 160 continuity in the horizontal plane (See 169 in FIG. 1A), or the lateral transfer plate 160 may abut the adjacent lateral transfer plate 160 without overlap.

Historically, panel designs ignored integrated fireblocking. Here, the lateral transfer plate 160 may have a fire retardant layer above or below the lateral transfer plate 160 to enable the lateral transfer plate 160 with fireblock configuration to be used in a wall where fireblocking is desired, such as an exterior nonbearing wall in a multi-floor building. In accordance with an exemplary embodiment, one or more panels 150 comprising a lateral transfer plate 160, and/or a lateral transfer plate 160 with fireblocking configuration are applicable to a multi-story assembly such as for use in balloon framing construction or a curtain wall assembly.

Another exemplary embodiment creates a slip transfer plate 165 placed at the top of an infill wall panel 150 to improve the structural integrity of the exoskeleton. The studs 120 in the exoskeleton are fastened to the slip transfer plate 165 through slotted 310 flanges in the plate 165, which allow for vertical movement of the floorplate 320 above the panel. The top of the studs 120 may protrude through the stud 120 profile penetrations 168 cut or punched in the slip transfer plate 165. The slip transfer plate 165 may be created in various shapes to match the profile of associated wall components. For example, a slip transfer plate 165 that mirrors the shape and dimensions of an "L" or "Z" shaped corner component in this panel system 100 can simplify the production and installation of the plate 165 atop a wall corner by eliminating the need for two separate plates and by avoiding cutting, mitering, and/or overlapping of two separate slip transfer plates 165.

In accordance with another exemplary embodiment to maximize the structural integrity of the steel exoskeleton and eliminate unbraced flanges, a groove 170 is cut at one or both ends of a panel 150 and a stud tie track 125 of cold formed light gage steel is inserted into the groove 170 in such a way that the stud tie track 125 is contiguous to the inside flange of each steel stud 120 that forms the wall panel 150 exoskeleton. The stud tie track 125 is then fastened to each contiguous stud 120 with appropriate fasteners, such as self tapping screws or in some applications may be welded to the contiguous studs 120, such as through contact welding. The stud tie track 125 ensures that the metal studs 120 will remain affixed to the panels 150 during shipping, handling, and installation. The stud tie track 125 also improves the structural strength of the panel 150 by bracing the flanges to resist torsional forces on the studs 120. In some applications, sill anchor bolts will protrude through the bottom plate 190 or track and fit inside the stud tie track 125. In an exemplary embodiment, tying studs 120 on each side of the exoskeleton together produces structural and cost benefits, such as permitting the use of lighter gages of steel stud 120 members in more standardized gages and spacing.

In an exemplary embodiment, an exemplary system 100 and panel 150 includes an integrated lateral transfer plate 160 that may be made from steel or, in certain applications, may be made from another material providing similar or better structural qualities, such as carbon fiber. In one embodiment of the lateral transfer plate 160, a light gage steel template such as that shown in FIG. 1D is created. For example, as shown in FIG. 1D, a top cut away view of a light gage steel rolled stock template prior to bending the stock along a flange bending line 162 to form one or more flanges into either a C shaped lateral transfer plate, a Z shaped lateral transfer plate, or an L shaped lateral transfer plate, and prior to punching or cutting the penetrations 168 for the stud profiles is depicted according to an exemplary embodiment. Penetrations 168, such as penetrations mirroring the shape of the stud 120 profiles used in the panel 150 are cut or punched in the template as shown in FIGS. 1B, 1C, and 1G. Flanges 161, 163, or 167 on the lateral transfer plate 160 are created from the template by bending or other means, as shown on FIGS. 1B, 1C, and 1G. The lateral transfer plate 160 can be designed with an integrated extension 167 that will overlap (See FIG. 1A, 169) the shear transfer plate on the adjacent panel 150, as shown in FIG. 1A. Fire retardant material can be added above or below the lateral transfer plate 160 to create a fireblocking configuration that suitably permits the use of the lateral transfer plate 160 in walls in which fireblocking is desired and/or required, including curtain walls in a multi-floor building. In accordance with an exemplary embodiment, one or more wall panels comprising a lateral transfer plate 160 in a fireblocking configuration are applicable to a multi-panel assembly such as for use in balloon framing or multistory building with curtain walls. In accordance with another exemplary embodiment, one or more wall panels comprising a lateral transfer plate 160 are applicable to a single story or multistory wall panel assembly without fireblocking added to the lateral transfer plate 160 in applications in which fireblocking is not desired.

A tire retardant such as one or more spray, coating, caulking, foil tape, elastomeric, gypsum board, mineral wool, or other material may be introduced above or below the lateral transfer plate 160. In an embodiment, a fire retardant material is placed on the lateral transfer plate 160 before the stud 120 profile penetrations 168 are cut or punched. In some embodiments, any gaps around the stud 120 penetrations 168 are sealed with fire retardant material, which may be the same or different fire retardant material used on the horizontal surface of the lateral transfer plate 160.

Figure 1E:
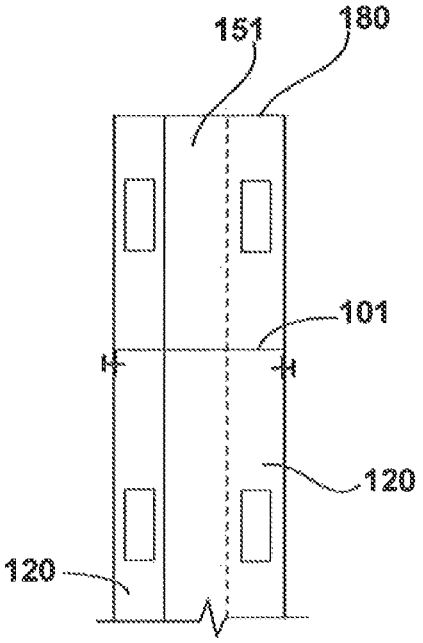
FIG. 1E is a wall panel section showing a C shaped lateral transfer plate integrated in a panel according to an exemplary embodiment.

Turning to FIG. 1E, a wall section of a panel 150 with an integrated lateral transfer plate 160 shows that the flanges on the lateral transfer plate 160 are secured to the studs 120, which may be via a fastener, contact or other welding, clipping or snapping mechanism, or other means of securing the lateral transfer plate 160 to the studs 120. Stated another way, FIG. 1E depicts a wall panel section showing a C shaped lateral transfer plate 101 integrated in the panel with the light gage steel exoskeleton of studs and track according to an exemplary embodiment. In accordance with an embodiment, and with reference to FIG. 1A, a plan view of the lateral transfer plate 160 with examples of the stud profile penetrations 168 to be cut or punched is depicted. Also, an example of an optional extension of the lateral transfer plate to overlap 169 the lateral transfer plate on an adjacent panel according to an exemplary embodiment; a part of the lateral transfer plate 160 may overlap the lateral transfer plate 160 on the adjacent wall panel 150. Such overlap may be unsecured, or may be secured by a fastener, contact or other form of welding, or an appropriate adhesive or sealant.

Figure 1F:
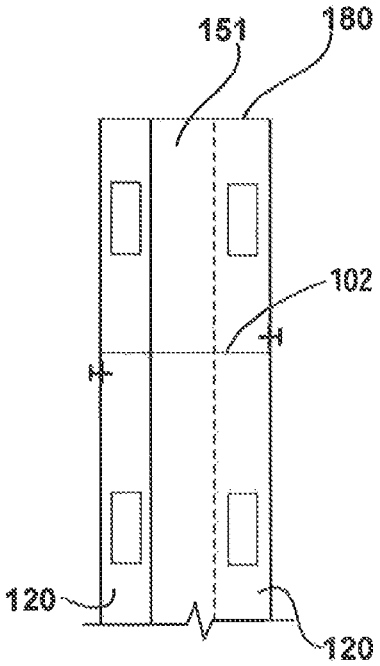
FIG. 1F is a wall panel section showing a Z shaped lateral transfer plate integrated in a panel according to an exemplary embodiment.
Figure 1G:
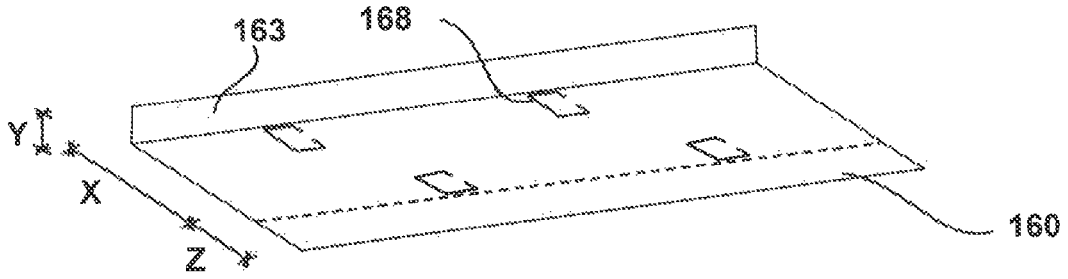
FIG. 1G depicts a side view of an "L" shaped lateral transfer plate according to an exemplary embodiment.

According to various embodiments, as shown in FIG. 1F, a wall panel section showing a Z shaped lateral transfer plate 102 integrated in the panel with the light gage steel exoskeleton of studs and track, in which embodiment one flange may be longer to serve as a ledger (not depicted).

Figure 2A:
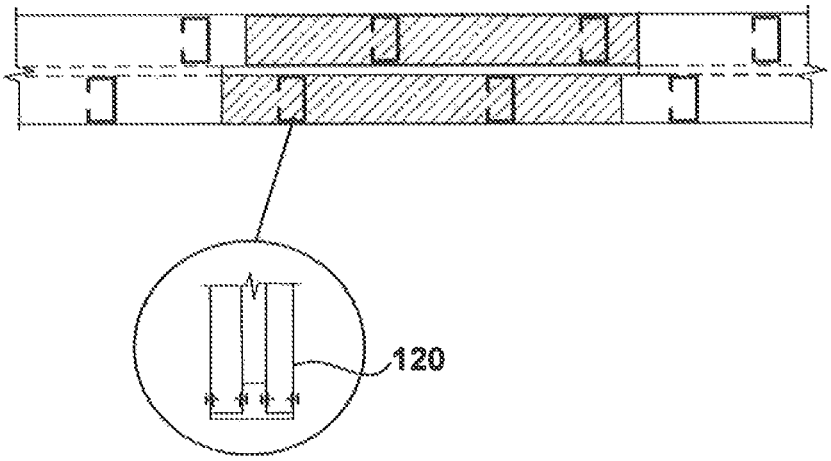
FIG. 2A is a plan view of a wall panel assembly according to an exemplary embodiment.
Figure 2B:
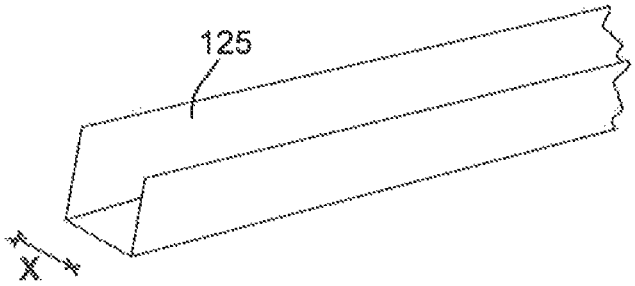
FIG. 2B is a side view of a stud tie track profile according to an exemplary embodiment.
Figure 2C:
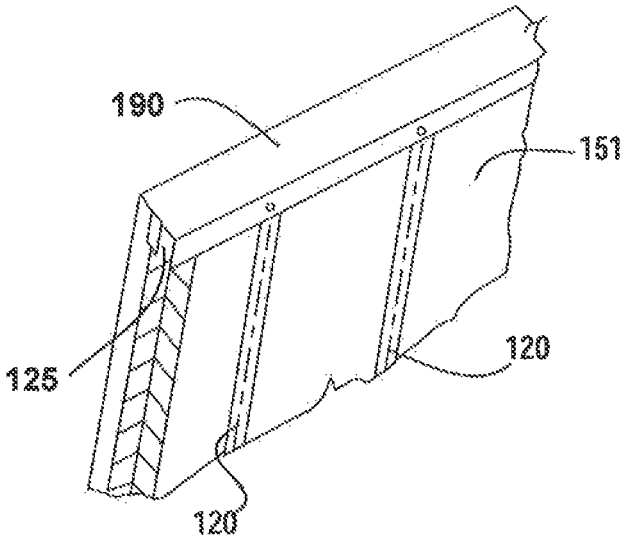
FIG. 2C is a side cut away view of a wall panel with stud tie track integrated into the panel comprising a lap joint according to an exemplary embodiment.
Figure 2D:
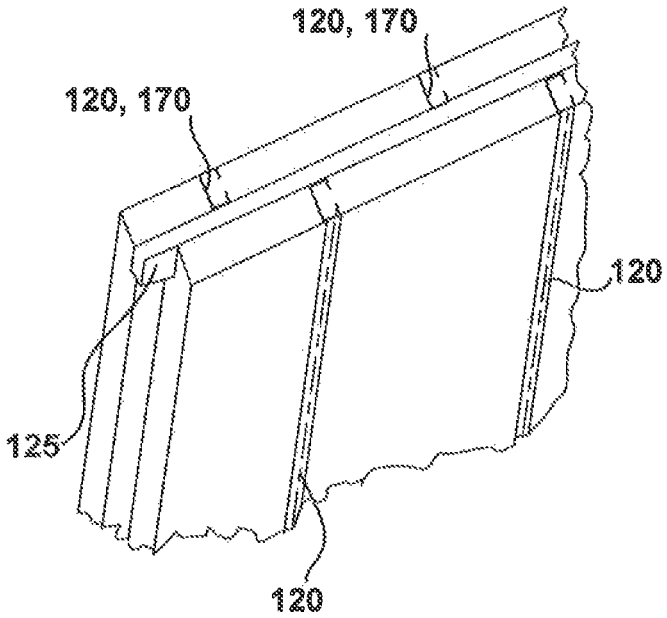
FIG. 2D is a side view of a wall panel with an integrated stud tie track according to an exemplary embodiment.

According to various embodiments, with reference to FIGS. 2A-2D the presently disclosed system and wall panel assembly may comprise a stud tie track. For instance, FIG. 2A depicts a plan view wall panel assembly with an exploded view of a portion of the panel that contains a light gage metal stud tie track secured to the studs with fasteners. FIG. 2B depicts a side view of a stud tie track profile. FIG. 2C depicts a side cut away view of a wall panel with stud tie track integrated into the panel, which panel has an illustrative lap joint. FIG. 2D depicts a side view of a wall panel with an integrated stud tie track and without any bottom track.

Figure 3A:
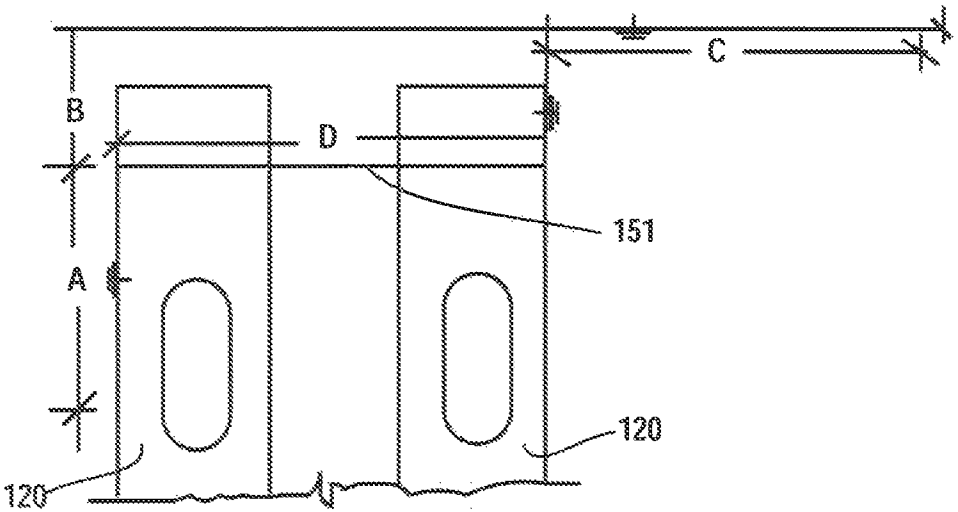
FIG. 3A is a side view of a slip transfer plate according to an exemplary embodiment.
Figure 3B:
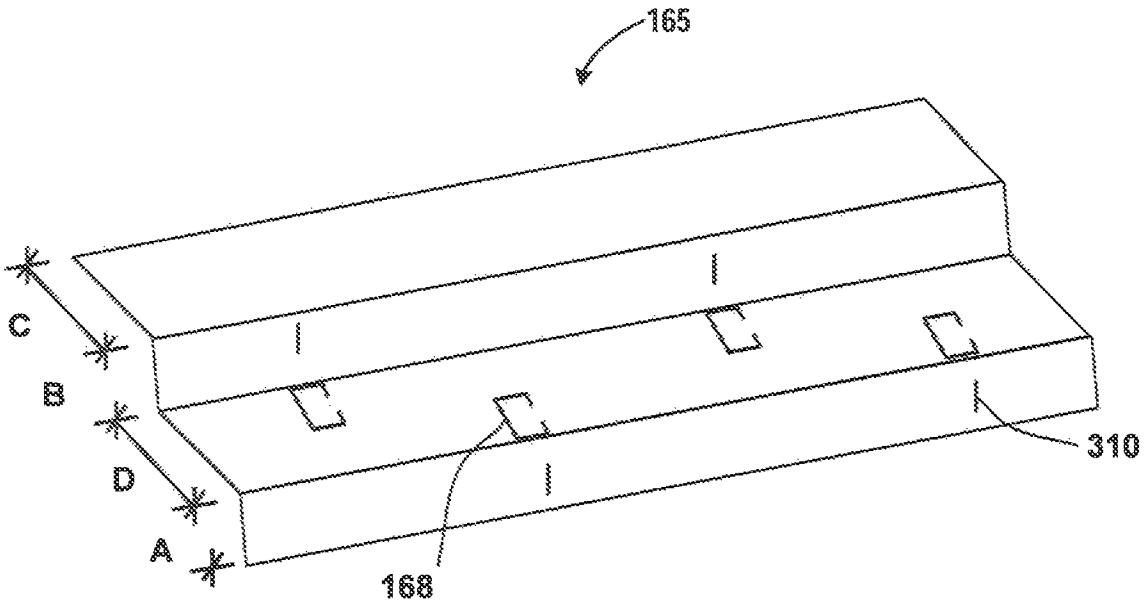
FIG. 3B is an isometric view of the slip transfer plate showing the stud profile penetrations and the slip fastener slots in the flanges according to an exemplary embodiment.
Figure 3C:
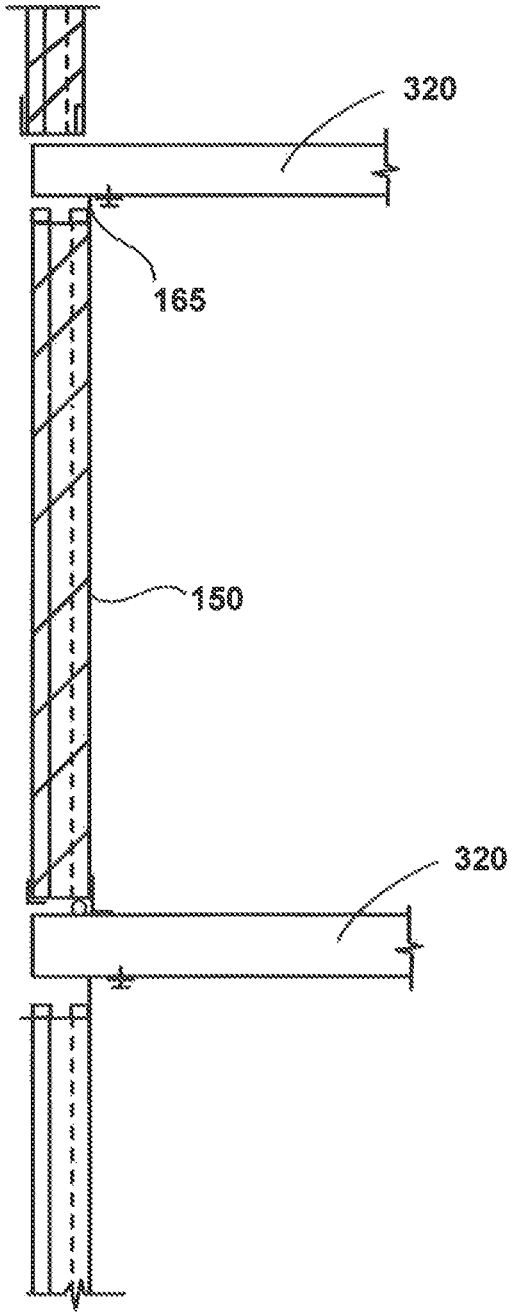
FIG. 3C is a side view of a wall panel with a slip transfer plate according to an exemplary embodiment.

In accordance with another exemplary embodiment, the top track 180 on panels 150 comprising an infill wall may be replaced by a fire-resistive slip transfer plate 165 such as that depicted in FIG. 3A and FIG. 3B. For instance, FIG. 3A depicts a side view of a slip transfer plate with light gage metal studs protruding through the plate according to an exemplary embodiment. FIG. 3A further depicts dimensions A, B, C, D. Dimension A represents the exterior slip flange dimension. Dimension B represents the interior slip flange dimension. Dimension C represents the slab attachment flange dimension. Dimension D represents the width of wall panel dimension. Furthermore, FIG. 3A illustrates a light gage metal stud protruding through metal stud profile penetration 168 and the top of EPS foam insulation 151. Dimensions A, B, C, D are further depicted in FIG. 3B. FIG. 3B depicts an isometric view of the slip transfer plate showing the stud profile penetrations and the slip fastener slots in the flanges according to an exemplary embodiment.

The slip transfer plate 165 improves the structural integrity of the panel 150 by tying the inner and outer steel studs 120 of the exoskeleton together. The slip transfer plate 165 attaches to the studs through slotted metal flanges in the plate 165, which flanges allow for vertical movement of the floorplate above the panel 150 that may be caused by thermal, seismic, wind loading, or any other load.

In accordance with another exemplary embodiment, the foam panel core above the lateral transfer plate 160 has precision grooves 170 pre-cut to hold and receive the studs 120 comprising the exoskeleton, and the foam panel 150 core above the lateral transfer plate 160 is integrated with the studs 120 that extend above the lateral transfer plate 160 in a manner that the studs 120 are securely fit in the pre-cut grooves 170 such that the lateral transfer plate 160 becomes integrated within the foam core of the wall panel 150.

Studs 120 may be inserted from the top and/or bottom of the panel 150 retained in the precision cut groove 170, cut to substantially mirror the exterior and interior of the stud 120. In this fashion, multiple panels 150 or core material may be coupled to a single stud 120. For instance, a thirty foot long stud 120 may be used to couple three 10 foot wide sections of core material (panels 150) together. In the panel 150 embodiment that incorporates one or more lateral transfer plates 160, the foam core above the lateral transfer plate 160 has precision cut grooves 170 to match the stud 120 profiles and such foam core is integrated with the portion of the panel 150 containing the lateral transfer plate 160 in a manner that the protruding studs 120 integrate into such grooves 170. This procedure may be repeated on the same panel 150 to create a panel 150 of any length with more than one lateral transfer plate 160.

The stud tie track 125 is formed from cold formed steel such that each flange of the stud tie track 125 will be contiguous to the inside web of each stud 120 forming the wall panel's 150 steel exoskeleton, as depicted in FIG. 2B and FIG. 2D, in one example embodiment, this steel is 20 gage. In one example embodiment, stud tie rack 125 has a channel approximately 1 inch deep. The stud tie track 125 is placed in a pre-cut precision groove 170 in an end of the wall panel 150 and fastened to the studs 120 with suitable fasteners, such as self tapping screws or other means of fastening such as welding with contact welding. The stud tie track 125 holds the studs 120 securely in the wall panel 150 to prevent movement of the studs 120 during assembly, shipping, and installation of the wall panel 150. Upon installation of a wall panel 150, the stud tie track 125 braces the interior flanges and increases the ability of the steel studs 120 to resist torsional forces, thereby improving the structural integrity of the wall panel 150. In one embodiment, the fasteners or anchor bolts that fasten the steel bottom plate to the foundation fit within the stud tie track 125.

In accordance with one aspect of the present invention, an exemplary system and panel includes an integrated fireblocking configuration that suitably permits the use of an exemplary panel 150 method and system in walls in which fireblocking is desired and/or required, including in a multi-floor building. For instance, with reference to FIG. 4, a side cut away view of integrated fireblocking according to an exemplary embodiment is depicted.

In accordance with an exemplary embodiment, one or more panels 150 comprising a fireblocking configuration are applicable to a multi-panel 150 assembly such as for use in balloon framing construction. In accordance with another exemplary embodiment, one or more panels 150 comprising a fireblocking configuration are applicable to potential or real gaps in fire protection formed along or through the panel 150 (in any axis, such as vertical or horizontal). For instance, the fireblocking configuration may be applied in the case of a soffit or beam enclosure.

Figure 4:
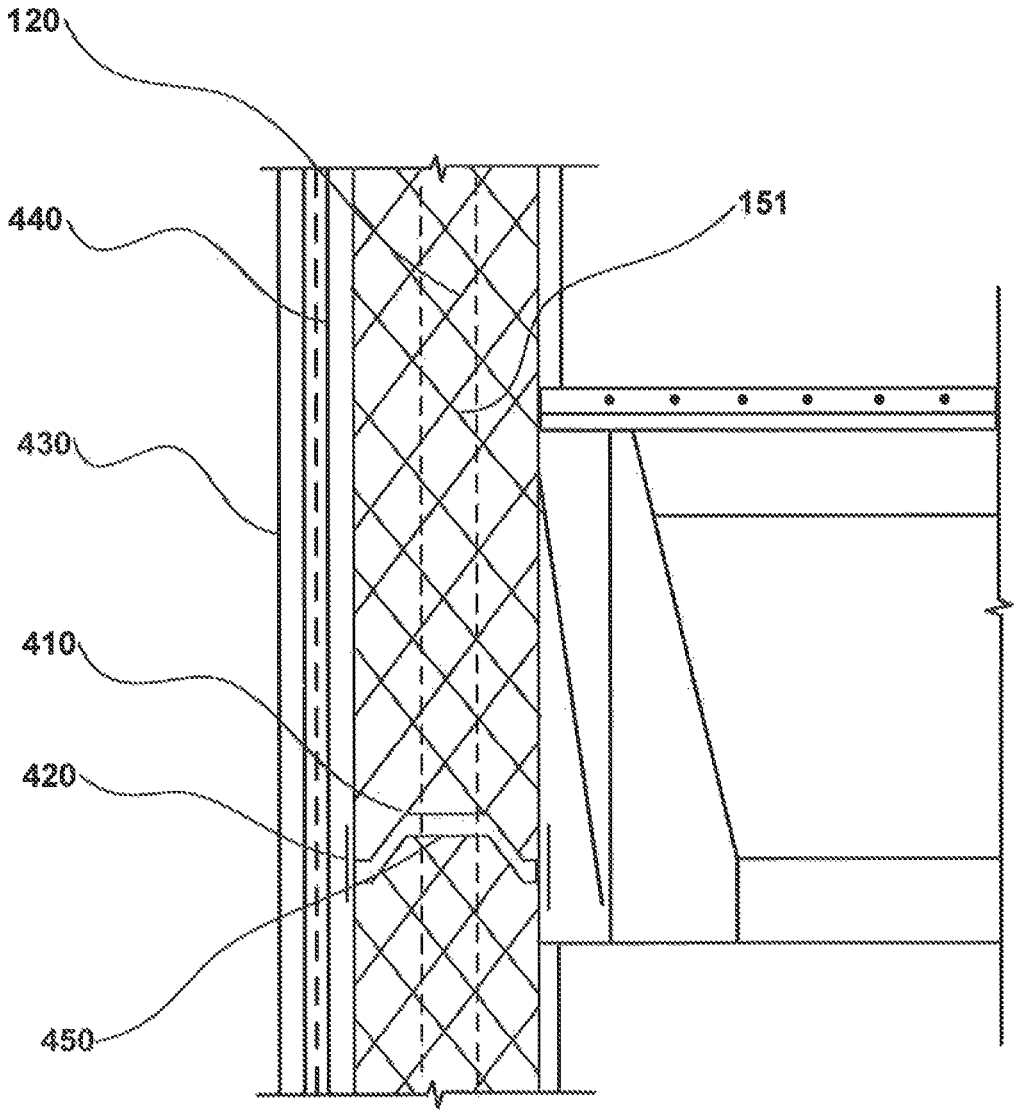
FIG. 4 is a side cut away view of integrated fireblocking according to an exemplary embodiment.

For example, with reference to FIG. 4, a side view of a wall system with integrated fireblocking construction is depicted. At or in the near proximity of the location where fireblocking is desired, a first panel 150 portion is configured for joining to a second panel 150 portion. The first panel 150 and second panel 150 portions may comprise a complete panel 150 size or they may comprise less than a complete panel 150 size. In some embodiments, the location where fireblocking is desired is within about 1.5 inches (plus or minus 0.75) of the bottom of the intersection of a floor to a wall panel 150 (e.g. bottom track 190), with the panel 150 oriented in a plane 90 degrees from the axis of the panel 150 construction (as shown).

This configuration for joining may comprise altering the surface properties of the first panel 150 to mate with a receiving second panel 150 by any suitable configuration, such as by establishing a joint and receiving well (as shown). Alternatively, tongue and groove, rounded, jagged, flat and combinations thereof are contemplated for this joint configuration. Alternatively, fireblocking could be supported by the use of plates, foils, and angles, as appropriate.

A fire retardant such as one or more spray 450, coating, caulking, foil tape, elastomeric, or other material may be introduced into the joint and/or applied to one or more joint members. In some embodiments, this spray may be 3M Firedam spray applied to both mating surfaces during manufacture, or field applied, as appropriate. This fire retardant may be applied over the entire joint and/or receiving well surface (s). In some embodiments, a first fire retardant is applied to the first panel 150 edge (e.g. joint) and a second fire retardant is applied to the second panel 150 edge, (e.g. receiving well). In an embodiment, the first and second panel 150 portions are placed in position and the fire retardant is sprayed into a gap between the joint members (first and second panel 150 portions). The gap between joint members may be any suitable distance. In some embodiments, this gap is between about 0.25 inches and about 1.25 inches. In another embodiment, this gap between the joint and the receiving well is about 0.5 inches.

In another embodiment, insulation is positioned between the joint and receiving well, such as mineral wool haft insulation 410 sandwiched and encapsulated between two metal foil sheets in a continuous roll seam in a manner that the configuration of the joint creates a structural component. Alternatively, a formed steel plate may be fastened to the studs to support the integrated fireblocking. This insulation may improve the acoustic (sound transmission class) and/or fire safety of the wall panel system.

In various embodiments, a second fire retardant, such as an aluminum foil tape 420, is applied over the fireblocking joint on the panel face. The second fire retardant may be suitably applied to continuously cover the fireblocking joint on the interior and exterior face of the panel 150. An exterior layer of sound, vapor, and/or noncombustible cladding 440, such as a drywall, plasterboard, cement board, gypsum board and/or the like may be applied to either side of the panel 150, such as by securing to one or more studs 120. An exterior cladding over flashing 430 may be secured to the exterior layer. In some embodiments, additional layers of vapor, sound and/or fire resistant materials may be coupled between the exterior layer and the exterior cladding over flashing 430.

Figure 5:
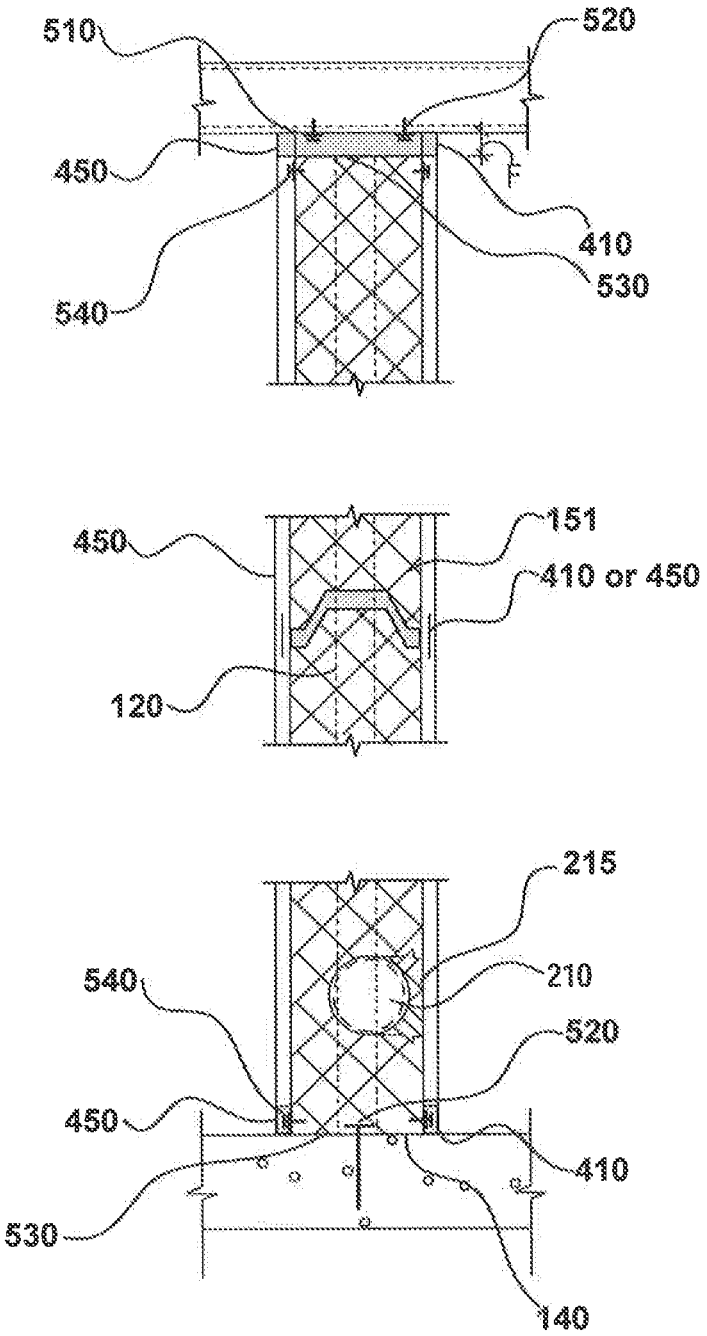
FIG. 5 is a side cut away view of a fire resistance rated wall panel system with integrated fireblocking according to an exemplary embodiment.

Turning to FIG. 5, a segmented side cut away view of a fire resistance rated wall panel system is depleted. As shown in the top of FIG. 5, one surface of a track is secured to a ceiling via a fastener, such as a steel slip channel 510 or steel clip secured by a power driven fastener 520. A joint surface of a panel 150 (e.g. top edge of the panel) is configured to be secured into the track. Between the track and the top joint surface of the panel 150 a fire retardant, such as one or more spray, coating, caulking, foil tape, elastomeric, or other material may be introduced into the joint and/or applied to the top joint surface and/or the track. This fire retardant may be applied over the entire joint surface. In some embodiments, a first fire retardant is applied to the top joint surface and a second fire retardant is applied to the track. In an embodiment, the panels 150 are placed in position and the fire retardant is sprayed into a gap between the joint members (track and top edge surface). As shown in FIG. 5, a fire stop spray and/or fire retardant may coat the intersection of the top exterior and interior face of the panel 150 and the track and surrounding surfaces. This fire stop spray and/or tire retardant may expand (and/or in some cases harden) when exposed to high temperature creating an additional structural element and/or enhancing protection from smoke and fire. In various embodiments, a structural element and/or fire retardant may be coupled to the fireblocking configuration disclosed herein and/or surrounding surfaces to further retain the passive fire protection system elements from weakening due to fire, heat, or from instant cooling, impact, and erosion effects of active fire protection, such as from water delivered via fire hose, sprinklers or fire extinguishers. In some embodiments, this coating of fire stop spray and/or fire retardant is applied such that there is at least a 2" overlap (FIG. 5; Dimension F) at the joint, though overlap can vary. In another embodiment, insulation is applied to the joint surface, such as mineral wool batt insulation.

As shown in the bottom of FIG. 5, one surface of a track may be secured to a floor via a fastener, such as a steel slip channel or steel clip secured by a power driven fastener 520 (e.g. at bottom track 190). A joint surface of a panel is configured to be secured into the track. Between the track and the bottom joint surface of the panel a fire retardant, such as one or more spray, coating, caulking, foil tape, elastomeric, or other material may be introduced into the joint and/or applied to the bottom joint surface and/or the track. This fire retardant may be applied over the entire joint surface. In some embodiments, a first fire retardant is applied to the bottom joint surface and a second fire retardant is applied to the track. In an embodiment, the panels are placed in position and the fire retardant is sprayed into a gap between the joint members (track and bottom edge surface). As shown in FIG. 5, a fire stop spray and/or fire retardant may coat the intersection of the bottom exterior and interior face of the panel 150 and the track and surrounding surfaces. In some embodiments, this coating of fire stop spray and/or fire retardant is applied such that there is at least a two inch overlap at the joint. In another embodiment, insulation is applied to the joint surface, such as mineral wool batt insulation. A horizontal multipurpose chase with interlocking expanded plug 215 (described in greater detail below) is also depicted in FIG. 5.

Cable and/or utility runs have been addressed in a rudimentary fashion by makers of building panels. In accordance with another aspect of the present invention, an exemplary system 100 and panel 150 is configured to provide a utility run (chase/channel 210) with precision cut grooves 170 for retaining cables, wires and tubing. In accordance with an exemplary embodiment, an exemplary panel 150 includes a multi-purpose EPS chase 210 with interlocking EPS plug 215 configured to provide compression channels 210 in the panel 150. The channels 210 are suitably sized to hold low voltage electrical wires, PEX plumbing, and the like. The interlocking EPS plug 215 may be sized to fit in the chase 210. This plug may increase the thermal efficiency by avoiding a larger thermal short.

In accordance with an embodiment, and with reference to FIG. **6*b* a precision cut chase 210 is depicted. This chase 210 may be formed using a computer numerical control (CNC) machine (described in greater detail below). This chase 210 may be formed in any desired axis of the panel. As shown, in various embodiments, the depth of the utility run 210 can be greater than the depth of the studs 120 in the panel so as to prevent the studs 120 from impeding utility runs 210. Additionally, the chase 210 can be at a depth to facilitate the use of the knockouts in the studs 120. In various embodiments, the interior surface of the chase 210 is precision cut to comprise one or more channels 212 for securely receiving at least one of a tube (such as PEX plumbing), electrical, data, voice, and/or audio wiring. Stated another way, these channels 212 are integral to the core formed by removing core material. Each channel 212 within the chase 210 may be cut at a pre-selected size to substantially mirror the portion of the exterior of a tube, electrical, data, voice, and/or audio wiring desired to be retained by each channel 212. These tubes, wires and/or cables may be press fit into place within each channel 212. Additionally, the disclosed utility chase 210 configuration with an EPS rib separating each component provides shielding between data and electrical wires in the same chase 210**, which may reduce or eliminate the need for mechanical devices to achieve this shielding. Also, eliminating the entanglement of electrical wiring reduces secondary electromagnetic fields caused by crisscrossed wires.

Each channel 212 may be suitably spaced within the chase 210 such that there is a gap between each tube, wire or cable. Each channel 212 may be marked to assist with installation and coordination of the tubes, wires and/or cables installed therein. Though FIG. **6*b* depicts 5 individual channels 212 (all of a similar size) within the chase 210 it should be appreciated that any suitable number of channels 212 formed in any suitable respective size may be formed in the chase 210**.

In according with various embodiments, an interlocking EPS plug 215 may be inserted into the chase 210. This configuration may provide compression channels 212 in the panel 150. The interlocking EPS plug 215 fits back in the chase 210 and increases the thermal efficiency by avoiding a larger thermal short. In some embodiments, the plug 215 is formed from a portion of the material removed while cutting the chase 210 from the core material. This method may both minimize waste material and ensure a tight fit in the chase 210. The plug 215 is shown with a flat or substantially rectangular cross sectional shape, however it should be appreciated that the plug 215 may be cut with surface features to substantially mirror the portion of the exterior of a tube, electrical, data, voice, and/or audio wiring desired to be retained by each channel 212. The EPS plug 215 may be cut with tabs extending from the side surface such that the extending tabs provide for a securable semi-permanent or permanent pressure fit in the chase 210. Moreover, the chase 210 may be cut with ridged sidewalls to retain a plug 215 comprising extending tabs (as shown).

The chase 210 with precision cut channels 212 may be substantially rectangular (as shown) or may be curved (not depicted). Also depicted, in FIGS. 6*b*-6*d* a multipurpose chase 210 without precision cut channels 212 may be formed in the panel in any desired axis of the panel 150. In accordance with an embodiment, this multipurpose chase 210 may be precision cut to any desired shape or diameter in the core. This chase 210 may be formed in any desired axis of the panel 150. This chase 210 may be a straight run or may be oriented in any desired direction, such as having a bend and run from horizontal to vertical. As shown, in various embodiments, the depth of the utility run (e.g. chase 210) is greater than the depth of the studs 120 in the panel 150 so as to prevent the studs 120 from impeding utility runs.

Figure 6A:
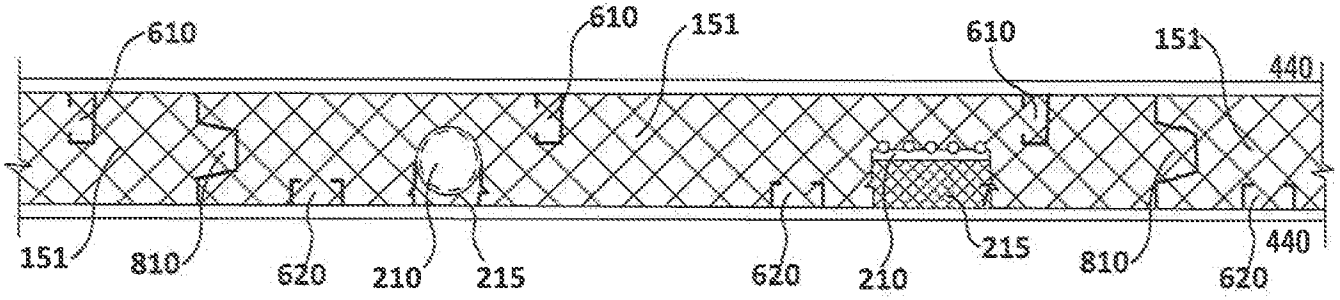
FIGS. 6A-6C depict a top cut away view of a wall panel comprising a formed chase (utility run) and a multipurpose chase (utility run) with studs oriented in both the X axis orientation and Y axis orientation according to an exemplary embodiments.
Figure 6B:
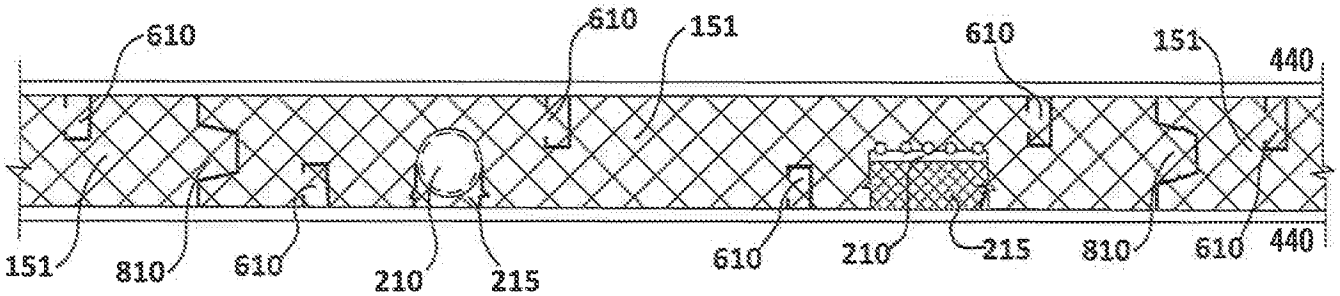
Figure 6C:
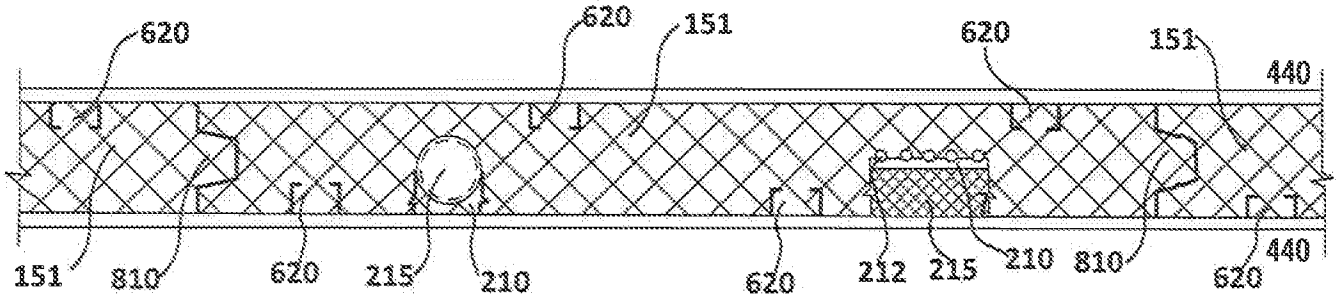

Also, with reference to FIGS. 6*a*-6*c*, precision cut stud grooves 170, such as hot wire cuts, are depicted. In various embodiments, a hot wire cut may be made in a panel to substantially mirror the exterior surface of a stud 120, such as a "C" shaped stud 120 in either or both of the X axis (See 610) or Y axis (See 620) orientations. This hot wire cut may be made by any suitable hot wire cutting tool; however, in an embodiment that achieves the desired precision the hot wire cutting tool is a CNC foam cutting machine with which the operator employs optimal combinations of cutting parameters and methods to achieve tight tolerances around the stud 120 profile. For example, FIG. 6A illustrates a top cut away view of an exemplary wall panel comprising a formed chase (utility run) and a multipurpose chase (utility run) with studs oriented in both the X axis orientation 610 and Y axis orientation 620. FIG. 6C depicts a top cut away view of an exemplary wall panel comprising a formed chase (utility run) and a multipurpose chase (utility run) with studs oriented in the X axis orientation 610. FIG. 6B depicts a top cut away view of an exemplary wall panel comprising a formed chase (utility run) and a multipurpose chase (utility run) with studs oriented in the Y axis orientation 620.

The CNC foam cutting machine may allow for end-to-end panel design. This end-to-end design is highly automated using computer-aided design (CAD) and computer-aided manufacturing (CAM) programs. The programs produce a computer file that is interpreted to extract the commands needed to operate a particular machine via a postprocessor, and then loaded into the CNC machines for production. The complex series of steps needed to produce any panel is highly automated and produces a part that closely matches the original CAD design. For instance, in one embodiment, automated measurements of a room layout via a room measuring device, such as a laser, may be made and transmitted and/or input, directly or indirectly through intervening processing, to the CNC machine for production. Alternatively, a program for automatically producing panel 150 configurations from a CAD design may be automatically translated into the machine code to cut the panels on a CNC machine.

Principles of the present disclosure may suitably be combined with principles for a panel system and method of manufacture as disclosed in U.S. patent application Ser. No. 12/715,288 filed on Mar. 1, 2010 and entitled, "CONSTRUCTION SYSTEM USING INTERLOCKING PANELS."

A C shaped conventional stud 120 is depicted, in part, because it is more commonly used in the industry; however any shape of stud that meets load requirements may be envisioned (in that regard, C-shaped conventional studs may even appear to pose more difficulty to precision fit in grooves due to the small "lip" configuration, but can be readily utilized in accordance with methods and systems disclosed). The studs 120 may be formed, such as with a bending or cold steel forming machine, to proprietary specifications and a precision cut 170 may be made in the panel 150 to substantially mirror these proprietary specifications/tolerances. Moreover, this stud 120 forming machine may by itself, or in combination with another machine, mechanically insert the formed studs 120 into the precision cut grooves.

In an embodiment, a large block of EPS material may cut into multiple panels 150 by using a specialized hot wire cutting device preprogrammed with specific instructions where cuts should be made. The travel path of the hot wire may be fine tuned such that minimal waste is created and avoiding a larger thermal short. The hot wire cutting machine may have more than one cutting element to cut multiple panels substantially simultaneously and/or to make multiple cuts in a single panel substantially simultaneously. The hot wire cutting device may travel/make cuts along any desired axis and/or direction. Also the panel 150 being cut may move in any desired axis/direction while being cut.

Figure 9A:
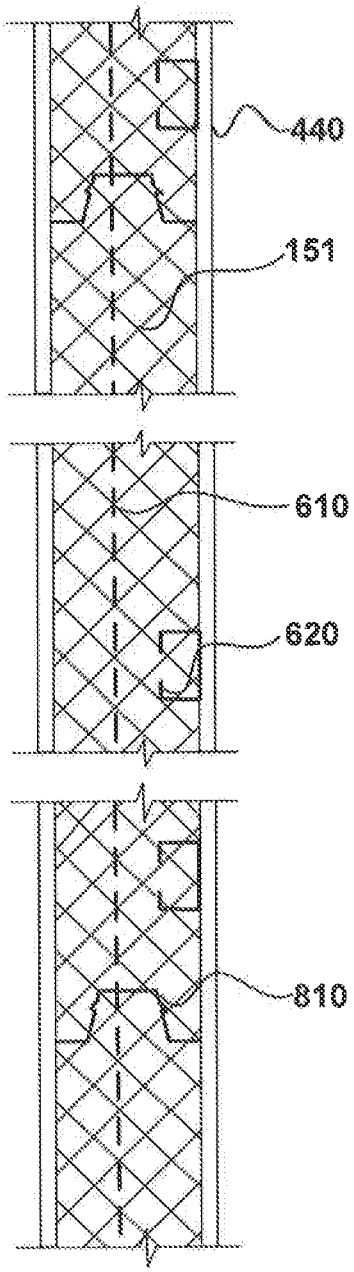
FIGS. 9A and 9B are segmented side cut away views of a matrix of interlocking panels according to an exemplary embodiment.
Figure 9B:
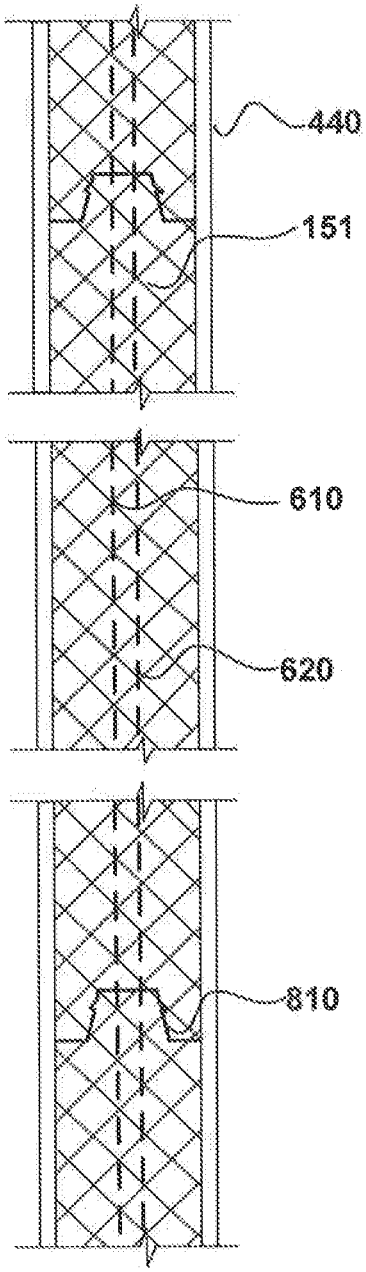

As discussed herein, studs 120 may be inserted from the top and/or bottom of the panel 150 retained in the precision cut groove 170, cut to substantially mirror the exterior and/or interior of the stud 120. In this fashion multiple panels 150 or core material may be coupled to a single stud 120. For instance a thirty foot long stud 120 may be used to couple three 10 foot wide sections of core material (panels) together. Similarly, a matrix of sections of core material may be coupled together using channels/grooves 170 and studs 120 in multiple axis. For instance, to create a wall, floor, ceiling, or roof (see FIG. 9*a* and FIG. 9*b*) panels 150 with an EPS core can be created in any length or width up to the length or width of the appropriate stud 120, and multiple panels 150 may be interlocked using various interlocking edge configurations precision cut in the foam core. Each of FIG. 9*a* and FIG. 9*b* depicts a matrix of interlocking panels 150 according to various embodiments.

As will be appreciated by one of ordinary skill in the art, the system for creating panels 150 and forming precision cuts 170 in panels based upon plans existing only as prints or existing as electronic CAD drawings may be embodied as a method, device for making the cuts, and/or a computer program product. Additionally, a scanning device may scan the profile of a steel stud 120 or steel track or other building component and convert the scanned image to the machine code used by the CNC machine to cut the corresponding groove 170 or other profile in the EPS. Accordingly, the aspects of the present disclosure may take the form of an entirely non-transitory software embodiment, an entirely hardware embodiment, or an embodiment combining aspects of both software and hardware. Furthermore, the present invention may take the form of a computer program product on a non-transitory computer-readable storage medium having computer-readable program code means embodied in the storage medium. Any suitable computer-readable storage medium may be utilized, including hard disks, CD-ROM, optical storage devices, magnetic storage devices, flash card memory and/or the like.

Figure 7:
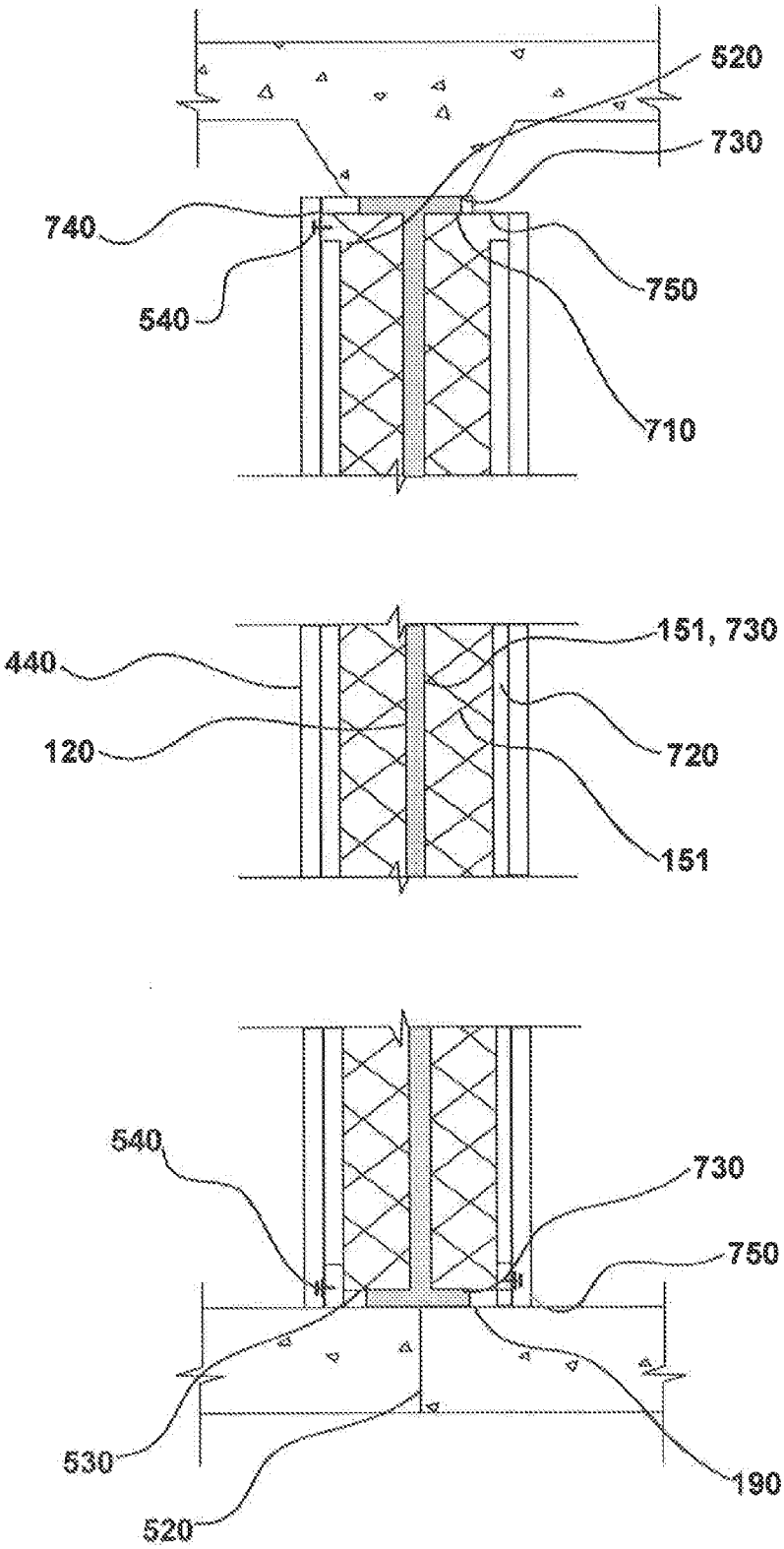
FIG. 7 is a side cut away view of a wall panel with a split steel track, integrated acoustical sound/fire material, and integrated side air gap according to an exemplary embodiment.

Historically, building panels exhibited poor thermal, vibration, and acoustic characteristics. In accordance with another aspect of the present disclosure, and with reference to FIG. 7, an exemplary system and panel 150 is configured for various other acoustical and thermal improvements. For instance, FIG. 7 is a side cut away view of an exemplary wall panel with a split steel track 710, integrated acoustical sound/fire material, and integrated side air gap 720 for improved thermal, fire, and acoustical properties. In accordance with an exemplary embodiment, a system 100 or panel 150 can comprise a split steel track 710 with integral gasket 730, such as a foam gasket, configured to create integral sound, vibration, and thermal break at the track. This track may be attachable to a ceiling or a floor. In various embodiments, the track 710 is secured via a power driven fastener 520 through the gasket. A steel runner 530, steel clip, steel angle 740 or other steel connector, in the case of a floor or ceiling respectively, may be screwed 540 to the track at one or more studs 120. A continuous bead of sealant 750 (such as acoustical/thermal/joint sealant) may be applied to the joint surface of the panel and the complementary steel track. This sealant may be applied to any joint in the system, such as the joint of the face of the panel and the chase plug. An air gap 720 between a vapor, sound and/or fire barrier and the panel creates a higher sound and vibration rating.

Figure 8:
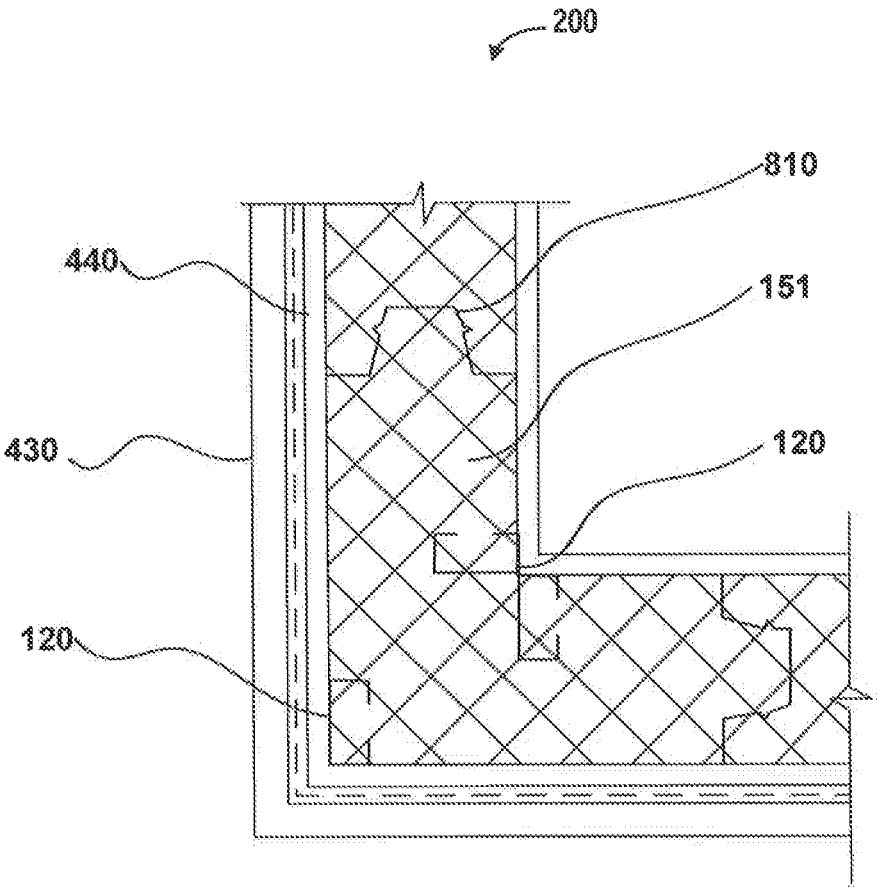
FIG. 8 is a top cut away view of a corner assembly of adjoining wall panels according to an exemplary embodiment.

In accordance with another embodiment, and with reference to FIG. 8, a corner system 200 is depicted. FIG. 8 depicts a top cut away view of a corner assembly of adjoining wall panels. In this system, an interlocking outside corner steel structural element (stud or other steel support), and an inside corner steel structural element (stud or other steel support) is depicted, as shown, these structural elements may be conventional studs. One or more sections of core material may be precision cut to receive the outside corner and inside corner structural elements.

The integral corner depicted in FIG. 8 may eliminate the thermal bridging associated with conventional construction. The corner system 200, comprising an integral corner, also allows for the continuity of horizontal utility chases that are difficult or impossible to facilitate in conventional construction. The corner system 200, comprising an integral corner also creates a unidirectional shear connection not created in conventional corner construction methods. This corner system 200, comprising an integral corner, may also eliminate voids and leaks and to combat a building thermal envelope being compromised as it is in conventional construction methods.

FIG. 8 also depicts a precision cut integral interlocking EPS joint 810. This joint and receiving well does not require secondary fasteners to couple a first panel 150 and a second panel 150 together. In various embodiments, an edge of a first panel 150 is fashioned with a precision cut 170 joint configuration and a second panel 150 is fashioned with a precision cut receiving well sized to substantially mirror the outer surface of the joint such that the two panels 150 may be pressure fit together. Though not necessary, retaining elements may be fashioned on the receiving well and/or the joint surface to securely hold the two panels 150 together. The present disclosure sets forth exemplary methods and systems for providing building panels with improved structural, thermal, acoustic, and fire-blocking characteristics. It will be understood that the foregoing description is of exemplary embodiments of the disclosure, and that the systems and methods described herein are not limited to the specific forms shown. Various modifications may be made in the design and arrangement of the elements set forth herein without departing from the scope of the disclosure. For example, the various components and devices can be connected together in various manners in addition to those illustrated in the exemplary embodiments, and the various steps can be conducted in different orders. These and other changes or modifications are intended to be included within the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the statements. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. Still further, as used herein, the term "about" shall mean within +/−25% of a number, unless stated otherwise. When language similar to "at least one of A, B, or C" is used in the statements, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

In the description herein, references to "various embodiments", "various aspects", "an aspect", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. After reading the description, it will be apparent to one skilled in the relevant art(s) how to implement the disclosure in alternative embodiments.

The invention claimed is:

1. A panel comprising:

a polymeric insulated core comprising a steel exoskeleton of steel studs comprising at least a first stud and a second stud; and a lateral transfer plate comprising:

a first opening cut or punched through the lateral transfer plate to receive the first stud, wherein the first opening corresponds to a profile of the first stud, whereby the first stud is inserted through the lateral transfer plate, a second opening cut or punched through the lateral transfer plate to receive the second stud, wherein the second opening corresponds to a profile of the second stud, whereby the second stud is inserted through the lateral transfer plate, wherein the first opening and second opening are disposed on opposite sides of a central longitudinal axis of the lateral transfer plate whereby the first opening is nearer an exterior of the panel and the second opening is nearer an interior of the panel, whereby the first opening and the second opening are staggered.

2. The panel of claim 1, further comprising fireblocking comprising a layer proximate to the lateral transfer plate and at least one of above and below the lateral transfer plate.

3. The panel of claim 1 wherein the polymeric insulated core further comprises a contiguous precision cut groove cut out of the core configured to receive a first steel stud, wherein the precision cut groove corresponds to a shape of the first stud.

4. The panel of claim 1, wherein the first stud is a conventionally shaped C steel stud.

5. The panel of claim 4, wherein conventionally shaped C steel stud comprises a web, a flange and a lip.

6. The panel of claim 1, wherein each of the panels includes at least one precision cut chase useable to receive utility runs, wherein the chase further comprises individual channels cut to friction fit at least one of a wire, cable or tube.

7. The panel of claim 1, wherein the lateral transfer plate comprises a flange configured to be fastened to the first stud.

8. The panel of claim 1, wherein the panel is constructed from parts in accordance with AISI S200 requirements.

9. The panel of claim 1, wherein the lateral transfer plate is configured to be integrated into a furring wall panel in which a plurality of studs are arranged in a row.

10. The panel of claim 1, wherein the lateral transfer plate is configured to disperse a load in the lateral direction.

11. The panel of claim 1, further comprising a slip transfer plate comprising an opening to receive the first stud, wherein the opening mirrors a shape of the stud and wherein the slip transfer plate comprises a flange having a slot to receive a fastener for coupling the first stud.

12. The panel of claim 1, further comprising an interlocking outside corner steel structural element and an inside corner steel structural element.

13. A panel, comprising:

a polymeric insulated core comprising a steel of exoskeleton steel studs comprising at least a first steel C shaped stud and a second steel C shaped stud;

at least one precision cut chase useable to receive utility runs, wherein the chase further comprises an individual channel cut to receive, via friction fit, at least one of a wire, cable or tube; and a lateral transfer plate comprising:

a first opening through the lateral transfer plate to receive the first steel C shaped stud, wherein the first opening mirrors the profile of the first C shaped stud, whereby the first C shaped stud is inserted through the lateral transfer plate, a second opening through the lateral transfer plate to receive the second steel C shaped stud, wherein the second opening mirrors the profile of the second C shaped stud, whereby the second C shaped stud is inserted through the lateral transfer plate, wherein the first opening and second opening are disposed on opposite sides of a central longitudinal axis of the lateral transfer plate.

14. The panel of claim 13, further comprising a stud tie track configured to eliminate unbraced flanges.

15. The panel of claim 13, wherein at least a portion of the channel corresponds to the dimensions of the at least one of the wire, the cable or the tube.

16. The panel of claim 13, wherein a top track of the panel is configured to be coupled to a bottom track of a second panel using a protruding single first steel C shaped stud.

17. The panel of claim 16, wherein this first steel C shaped stud may span at least one of more than, less than or the span of both the first panel and the second panel.

18. A panel, comprising:

a polymeric insulated core comprising a contiguous precision cut groove cut out of the core configured to receive a first C shaped stud slid into position, wherein the first C shaped stud is oriented such that a long side of the first C shaped stud is oriented orthogonal to the face of the panel, wherein the precision cut groove corresponds to a shape of the first C shaped stud; and a lateral transfer plate comprising:

a first C shaped opening through the lateral transfer plate to receive the first C shaped stud, wherein the first C shaped opening corresponds to a shape of the first C shaped stud, whereby the first C shaped stud is inserted through the lateral transfer plate, a second opening through the lateral transfer plate to receive a second steel C shaped stud, wherein the second opening mirrors the profile of the second C shaped stud, whereby the second C shaped stud is inserted through the lateral transfer plate, wherein the first opening and second opening are disposed on opposite sides of a central longitudinal axis of the lateral transfer plate.

19. A panel, comprising:

a lateral transfer plate comprising:

a first opening cut or punched through the lateral transfer plate to receive a first stud, wherein the opening corresponds to a shape of the first stud whereby the first stud is inserted through the lateral transfer plate; and a second opening cut or punched through the lateral transfer plate to receive a second stud, wherein the second opening corresponds to a shape of the second stud, whereby the second stud is inserted through the lateral transfer plate, wherein the first opening is nearer an exterior of the panel and the second opening is nearer an interior of the panel, whereby the first opening and the second opening are staggered along a width of the lateral transfer plate, and wherein the studs do not extend through the panel from the interior to the exterior.

* * * * *